US010052505B2

(12) United States Patent
Colorado

(10) Patent No.: US 10,052,505 B2
(45) Date of Patent: Aug. 21, 2018

(54) QUICK RELEASE SLIDE CLIP MECHANISM

(71) Applicant: FIRE INNOVATIONS LLC, Petaluma, CA (US)

(72) Inventor: Juancarlos Colorado, Petaluma, CA (US)

(73) Assignee: FIRE INNOVATIONS LLC, Petaluma, CA (US)

( * ) Notice: Subject to any disclaimer, the term of this patent is extended or adjusted under 35 U.S.C. 154(b) by 0 days.

(21) Appl. No.: 15/334,236

(22) Filed: Oct. 25, 2016

(65) Prior Publication Data

US 2018/0111013 A1 Apr. 26, 2018

(51) Int. Cl.

| | |
|---|---|
| ***A44B 17/00*** | (2006.01) |
| ***A62B 25/00*** | (2006.01) |
| ***A62B 9/04*** | (2006.01) |
| ***A44B 18/00*** | (2006.01) |
| ***A44B 11/26*** | (2006.01) |

(52) U.S. Cl.

CPC ..... *A62B 25/00* (2013.01); *A44B 11/266* (2013.01); *A44B 17/0041* (2013.01); *A44B 18/00* (2013.01); *A62B 9/04* (2013.01)

(58) Field of Classification Search

CPC ..... A44B 17/00; A44B 11/25

USPC ..... 224/269, 271; 24/3.7, 580.1

See application file for complete search history.

(56) References Cited

U.S. PATENT DOCUMENTS

| | | | | |
|---|---|---|---|---|
| 3,191,828 | A * | 6/1965 | Senne | A62B 9/04 224/604 |
| 5,131,576 | A * | 7/1992 | Turnipseed | A45F 3/08 224/262 |
| 5,249,890 | A * | 10/1993 | Bergstrom | B63C 11/02 405/185 |
| 5,462,214 | A * | 10/1995 | Buswell | A45C 11/38 224/242 |
| 5,836,489 | A * | 11/1998 | Swetish | A45F 3/10 224/262 |
| 6,041,444 | A * | 3/2000 | McKinney | A45F 3/14 2/310 |
| 6,079,602 | A * | 6/2000 | Howell | A45F 3/047 224/262 |
| 6,176,403 | B1 * | 1/2001 | Svare | A45F 5/00 206/315.1 |
| 6,321,959 | B1 * | 11/2001 | Howell | A45F 3/047 224/262 |
| 6,732,834 | B2 * | 5/2004 | Colorado | A62B 35/0031 182/3 |

(Continued)

*Primary Examiner* — Brian D Nash

(74) *Attorney, Agent, or Firm* — Craig M. Stainbrook; Stainbrook & Stainbrook, LLP

(57) ABSTRACT

A quick release apparatus for rapid disconnection of a waist belt from a self-contained breathing apparatus support frame, including frame connectors disposed on a lumbar support pad. The frame connectors and inserted through horizontal slots on the SBCA support frame and present an aperture for insertion of slide clips that tether the SCBA support frame to the lumbar support pad. The support pad, in turn, may be removably attached to a trucker's belt or integrated therein. In an emergency, the slide clips may be rapidly removed with a simple pull to effect a full and compete release of the SCBA support frame from the waist belt while leaving the waist belt and its accoutrements on the user.

14 Claims, 8 Drawing Sheets

(56) References Cited

U.S. PATENT DOCUMENTS

| | | | | |
|---|---|---|---|---|
| 7,028,873 | B1 * | 4/2006 | Collier | A45F 3/08 224/628 |
| 7,080,430 | B2 * | 7/2006 | Wemmer | A41D 13/0012 24/3.7 |
| 8,006,877 | B2 * | 8/2011 | Lowry | A45F 3/04 224/262 |
| 8,181,833 | B2 * | 5/2012 | Wangeby | A45F 3/14 224/262 |
| 8,312,600 | B2 | 11/2012 | Colorado | |
| 8,336,171 | B2 | 12/2012 | Colorado | |
| 8,356,692 | B1 * | 1/2013 | Steck | A62B 35/0025 182/129 |
| 8,505,171 | B2 | 8/2013 | Colorado | |
| 8,523,029 | B2 * | 9/2013 | Rogers | A45F 5/02 224/182 |
| 8,695,171 | B2 * | 4/2014 | Colorado | A45F 3/10 224/675 |
| 9,033,616 | B2 * | 5/2015 | Krumhauer | B63C 11/2245 405/186 |
| 9,220,333 | B2 * | 12/2015 | Losos | A45F 3/10 |
| 9,586,065 | B2 * | 3/2017 | Losos | A62B 9/04 |
| 2007/0090137 | A1 * | 4/2007 | Kim | A45F 3/047 224/153 |
| 2009/0071990 | A1 * | 3/2009 | Jardine | A45F 3/10 224/155 |
| 2009/0159364 | A1 * | 6/2009 | O'Brien | A45F 3/14 182/3 |
| 2010/0243687 | A1 * | 9/2010 | Liang | A45C 3/001 224/148.6 |
| 2013/0240292 | A1 * | 9/2013 | Steck | A62B 9/04 182/3 |

* cited by examiner

QUICK RELEASE SLIDE CLIP MECHANISM

CROSS REFERENCES TO RELATED APPLICATIONS

Not applicable. The present application is a first and originally filed United States Utility Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

Field of the Invention

This invention relates to firefighter safety equipment, and more particularly to a quick release system for connecting and rapidly decoupling a firefighter's self-contained breathing apparatus to a waist belt and safety harness. Even more particularly, the present invention relates to a quick-release harness system for connecting an SCBA to a firefighter or rescue worker's turnout gear trucker's belt such that the quick-release system may be disconnected and separated from the trucker's belt in a matter of only a few seconds

Background Discussion

Quick release systems for firefighter SCBA frames are known. Indeed, the present inventor has thrice advanced the art through the patent process by obtaining patents for, and thus disclosing to the public, three distinct systems for rapidly coupling and decoupling an SCBA frame to a firefighter waist belt and safety harness. U.S. Pat. No. 8,312,600, issued Nov. 29, 2012, U.S. Pat. No. 8,336,171, issued Dec. 25, 2012, and U.S. Pat. No. 8,505,171, issued Aug. 13, 2013, each to Colorado, describe kindred systems. Each patent is incorporated in its entirety by reference herein.

The present invention is a further advancement falling generally under the conceptual umbrella covering the above-described patented systems.

BRIEF SUMMARY OF THE INVENTION

The present invention is an improved system for coupling an SCBA frame to a waist belt while also providing means for rapidly disconnecting or decoupling the SCBA from the waist belt while concurrently leaving the waist belt on the wearer. In its most essential aspect, the present invention is a quick release apparatus for selective connection and rapid disconnection of a rescue worker's waist belt from a self-contained breathing apparatus (SCBA) belt or frame. In a preferred embodiment, the apparatus includes three essential elements: the first is a belt connection apparatus that is connected to a wearer's waist belt; the second is an SCBA frame connection apparatus that is connected to the lower back support portion of an SCBA frame; and the third is a coupling apparatus for connecting the belt connection apparatus to the SCBA frame connection apparatus. The coupling apparatus includes at least one rapid release member that is pulled by the wearer to effect a very rapid disconnection of the belt connection apparatus from the SCBA frame connection apparatus. When the wearer pulls either one or two pullable rapid release members out and away from the SCBA frame, the SCBA is completely disconnected from the waist belt such that the wearer can remove the SCBA from his or her body while leaving the waist belt and any attached accoutrements in place. Thus, the wearer can jettison the SCBA essentially immediately, so as to improve mobility and maneuverability when the SCBA has become entangled or otherwise encumbers and endangers the user. At the same time the user retains the waist belt in the event it is needed as an essential element in a rapid egress harness and as a means for carrying tools that may yet be required.

BRIEF DESCRIPTION OF THE SEVERAL VIEWS OF THE DRAWINGS

The invention will be fully understood and its various objects and advantages will become apparent when consideration is given to the following detailed description, which makes reference to the annexed drawings, wherein.

DETAILED DESCRIPTION OF THE INVENTION

Figure 1:
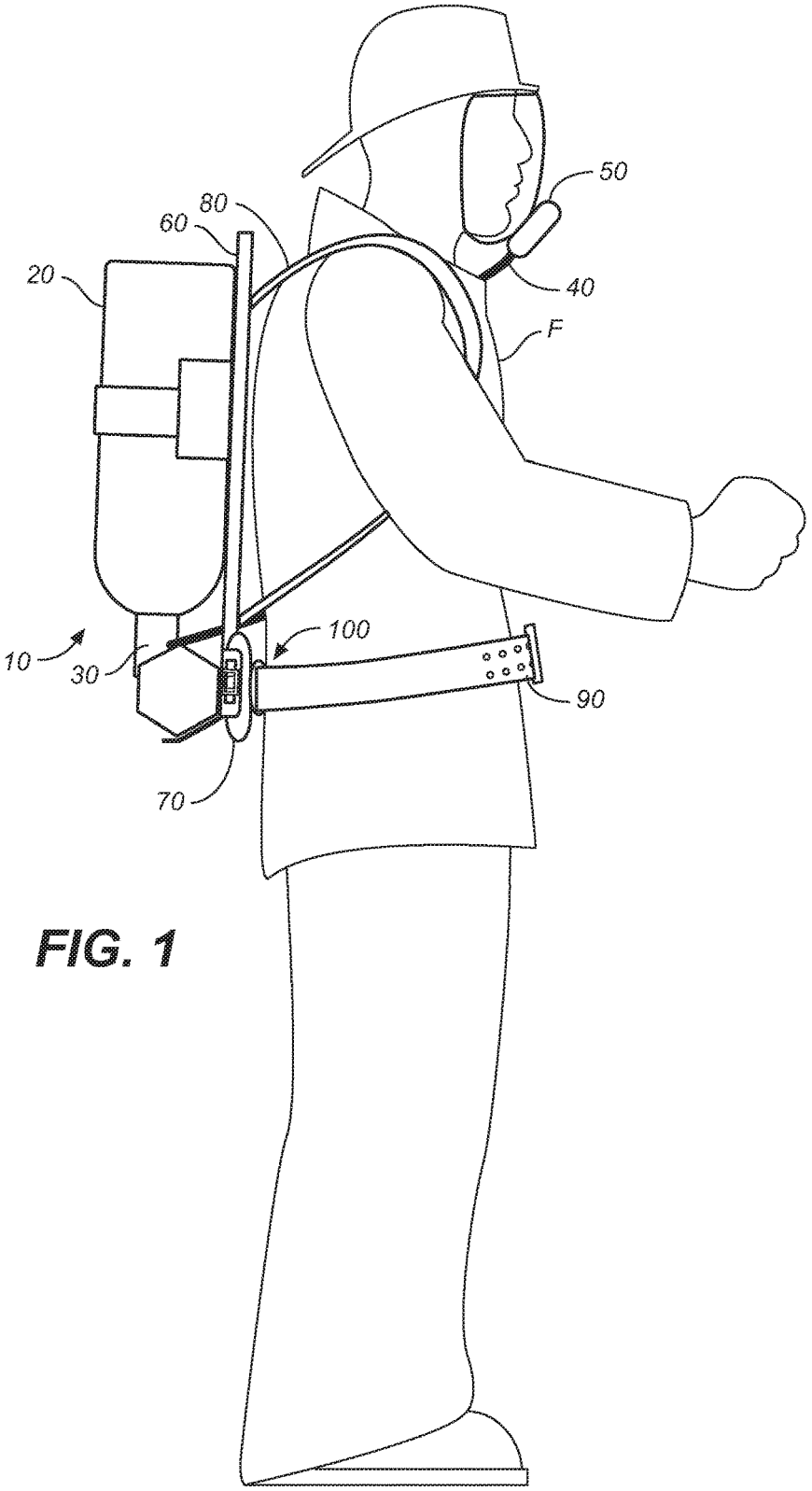
FIG. 1 is a schematic side view in elevation showing a firefighter wearing a self-contained breathing apparatus, which is attached at the lower lumbar support member of the SCBA frame to a trucker's belt using an embodiment of the quick release system of the present invention.

Referring first to FIGS. 1 through 4C, wherein like reference numerals refer to like components in the various views, there is illustrated therein a first preferred embodiment of a new and improved quick release apparatus for an SCBA frame, generally denominated 100 herein.

FIG. 1 shows a firefighter F wearing a self-contained breathing apparatus 10, which includes a tank 20 with a pressure regulator 30, an air line 40, and a protective inhalation face mask 50. The tank is mounted and supported on a rigid frame 60 having, among other things, a lower lumbar support plate 70 and shoulder straps 80. The frame is connected at its lower lumbar support plate to a trucker's belt 90 using the quick release apparatus of the present invention 100.

Figure 2A:
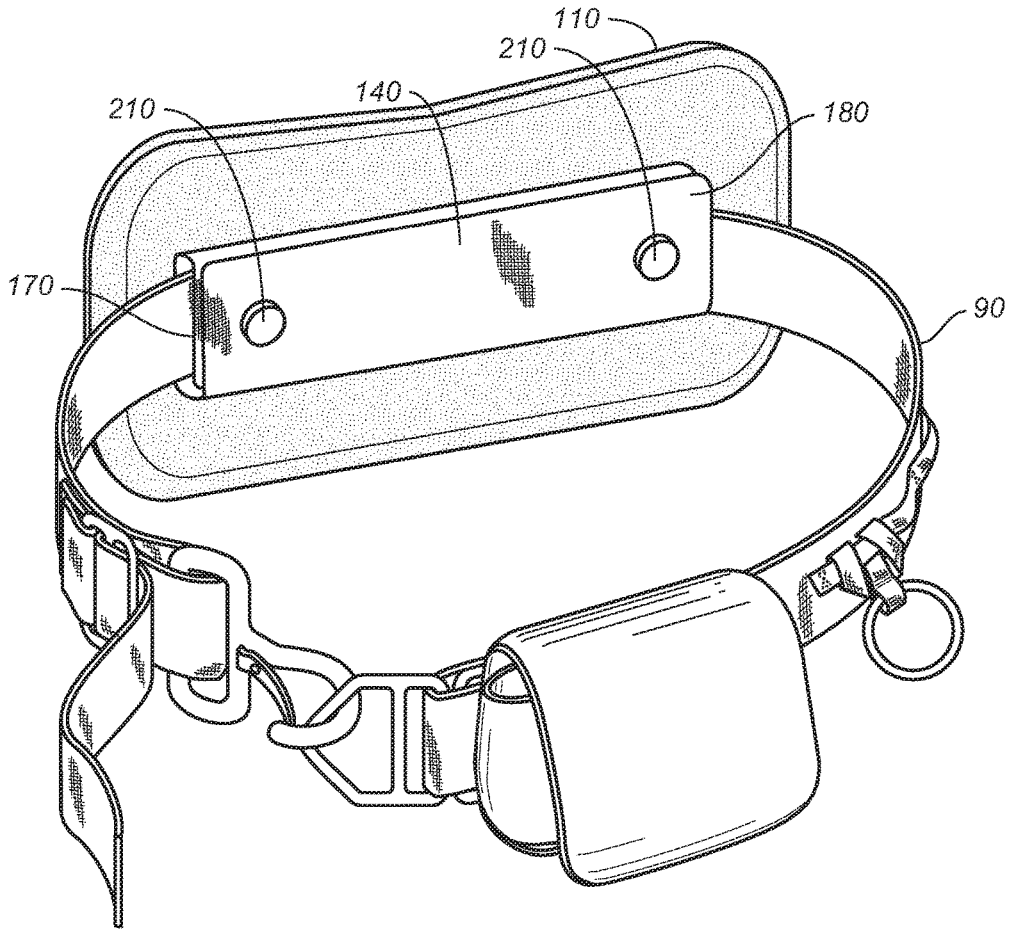
FIG. 2A is an upper right rear perspective view showing the novel quick release system disposed on a trucker's belt.
Figure 2B:
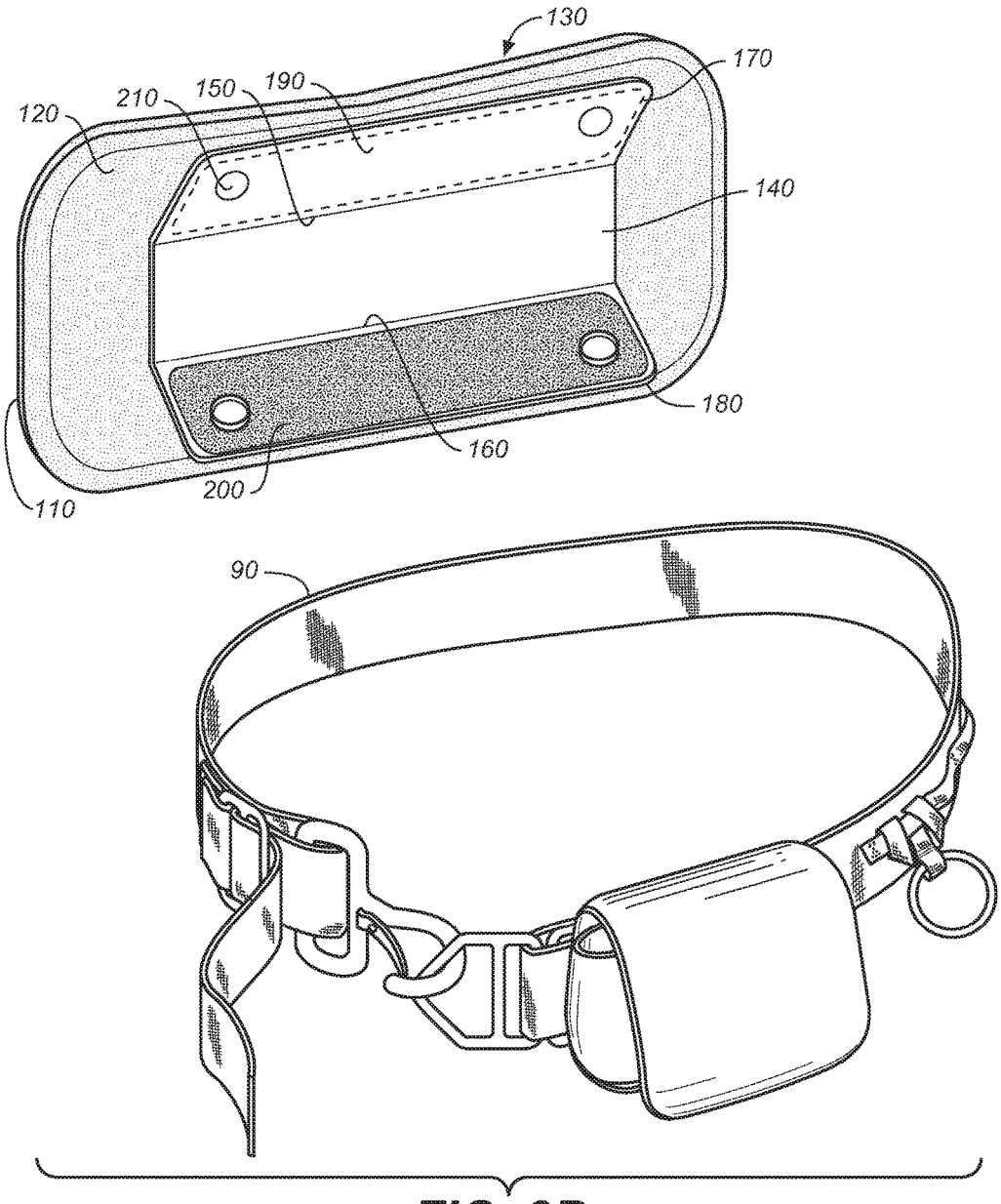
FIG. 2B is an upper right rear perspective view of the lumbar support pad element detached from a trucker's belt.

FIG. 2A is an upper right perspective view showing the lumbar pad portion of the novel quick release system releasably disposed on a trucker's belt, while FIG. 2B is the same view showing the lumbar pad portion detached from the trucker's belt. These views show the structural and operational features of a principal unit of the present invention and the general manner in which it is coupled to a trucker's belt 90. The elements include a generally rectangular frame-connecting lumbar support pad 110 for attachment to the interior side of the lower lumbar support plate 70. The lumbar support pad includes a perimeter edge 115, a rear side 120, a front side 130, and a selectively openable belt capturing sleeve 140 having an upper fold 150, a lower fold 160, upper and lower flaps, 170, 180, each having hook and loop fastener material, 190, 200, respectively (the former in phantom), and snaps 210. The frame-connecting lumbar support pad is preferably fabricated of aramid fiber webbing (such as KEVLAR® or NOMEX®) or other suitably sturdy natural or synthetic, heat and fire resistant material, and the webbing may cover a padding of some kind, according to the comfort needs and preferences of the wearer. [KEVLAR and NOMEX are both registered trademarks of E. I. du Pont de Nemours and Company.]

Figure 3A:
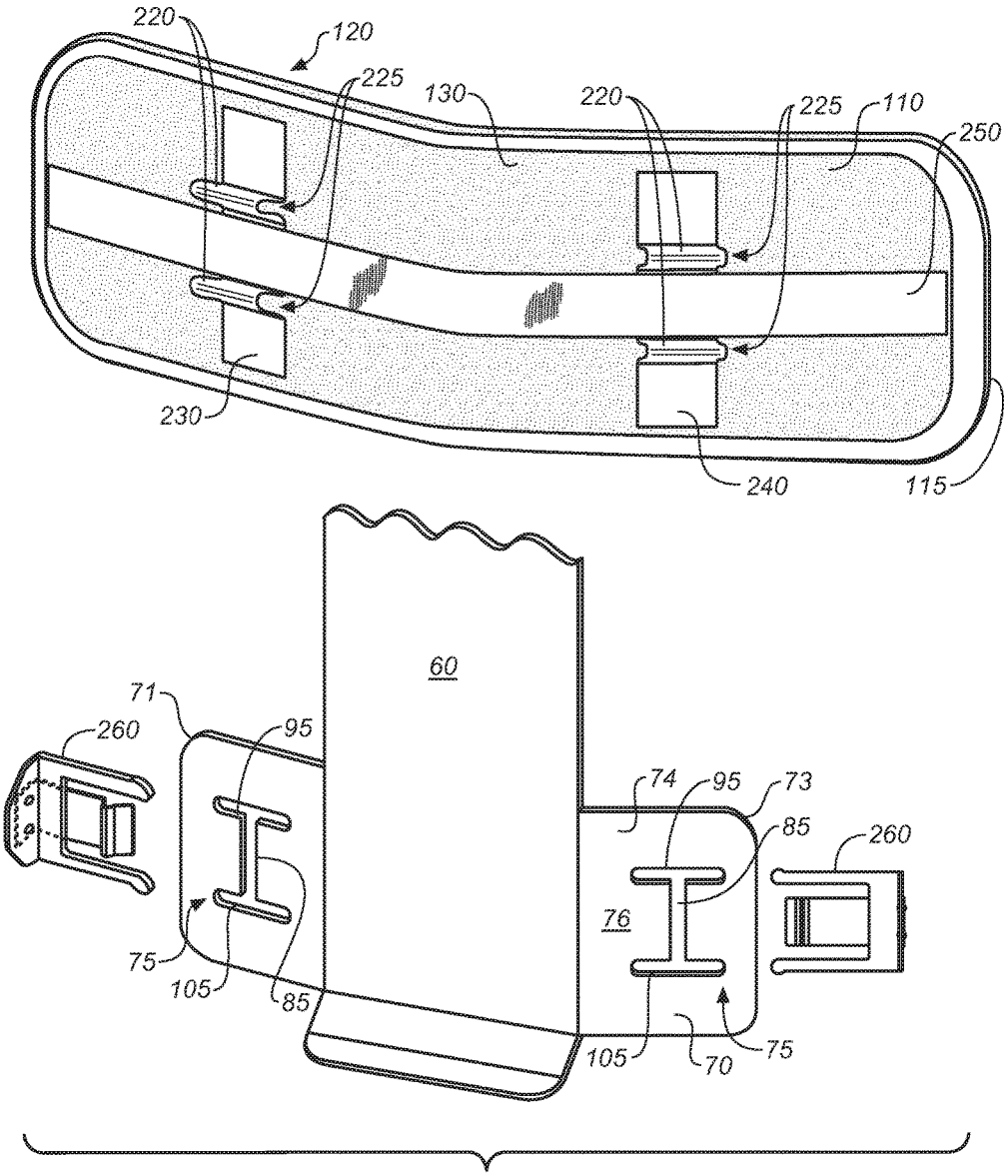
FIG. 3A is an upper front left exploded view of an embodiment of the quick release system for an SCBA frame of an embodiment of the present invention.
Figure 3B:
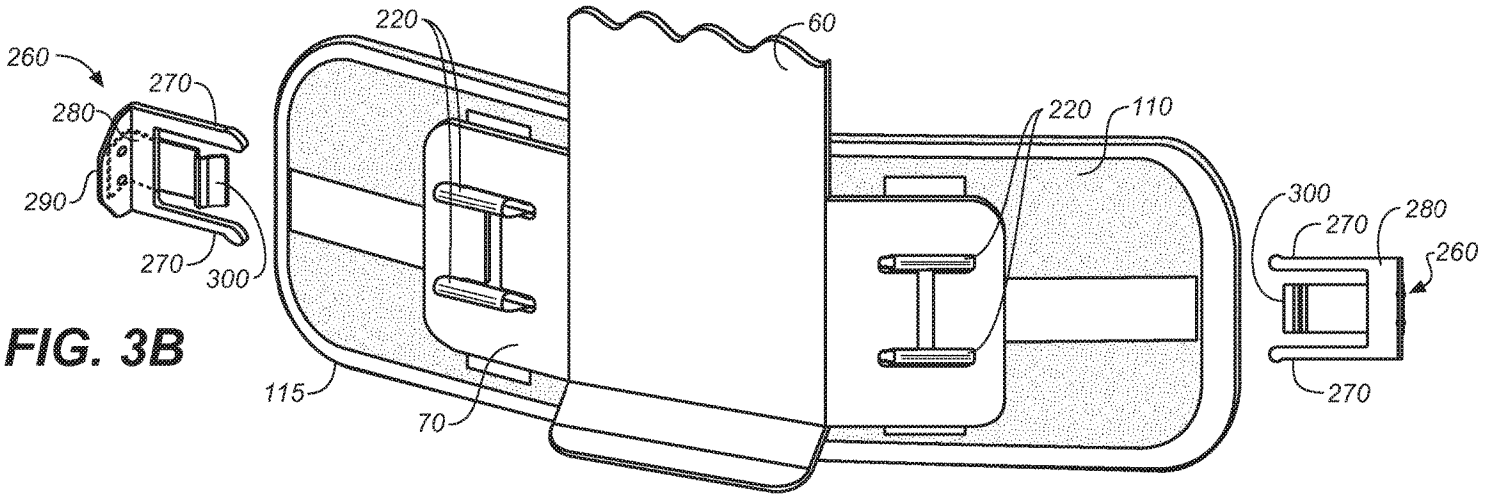
FIG. 3B is a partial front left perspective view showing the elements for connecting the lumbar support pad to the lumbar portion of an SCBA frame.
Figure 3C:
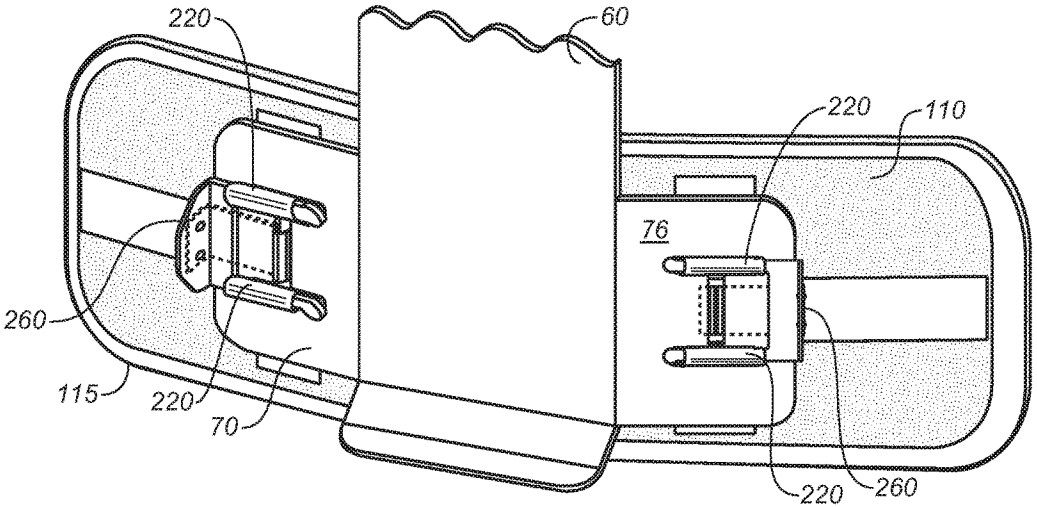
FIG. 3C is an upper left perspective view showing the lumbar pad connecting and secured with slide clips to the lumbar portion of the SCBA frame.
Figure 4A:
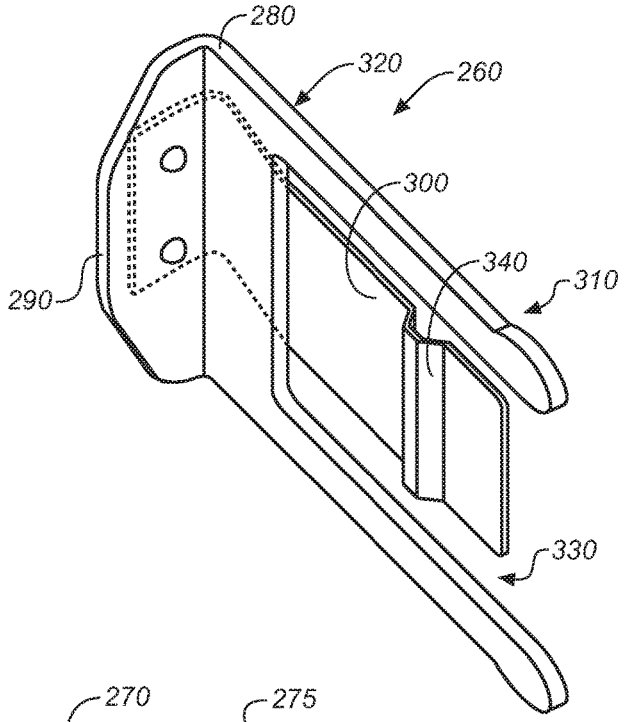
FIG. 4A is a perspective view showing an embodiment of the slide clip of the present invention.
Figure 4B:
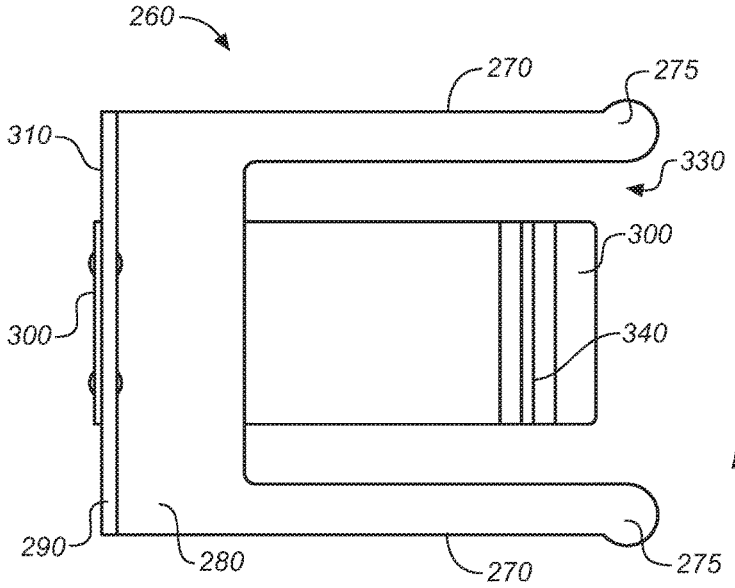
FIG. 4B is a front view in elevation thereof.
Figure 4C:
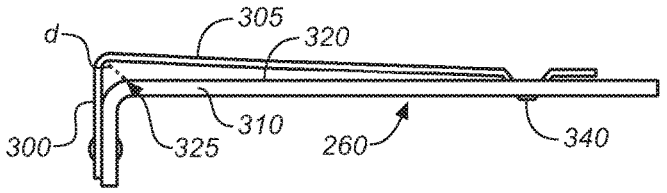
FIG. 4C is a top plan view thereof.

Referring now to FIGS. 3A through 3C, the frame-connecting lumbar support pad 110 also includes frame connectors 220 disposed on its front side 130 for releasable connection to the SCBA lower lumbar support plate 70. It will be noted that the SCBA lower lumbar support plate is adapted to accommodate the frame connectors. In an embodiment, the SCBA frame is either modified or configured in manufacture to include the provision of two I-shaped slots 75 proximate the left and right sides 71, 73 of the lower lumbar support plate. Each of the I-shaped slots includes a vertically-disposed slot portion 85, joining horizontally-oriented upper and lower slots 95, 105, respectively. The salient features are the horizontally disposed slots. Accordingly, in an embodiment, the slot configuration may comprise only the horizontally-oriented slots without a joining vertically oriented slot. In another embodiment, a single horizontal slot may be provided for use in cooperation with correspondingly configured frame connectors, as described below.

In an embodiment, the frame connectors are formed from first and second vertically oriented fabric straps 230, 240 sewn into the front side 130 of the lumbar support pad 110. Two bends are fashioned in each of fabric straps and remain unattached to the lumbar pad, thereby creating fabric loop portions that extend outwardly from the front side 130 of the lumbar support pad. These are the frame connectors 220, and each include apertures 225 formed in the fabric loops. Also sewn onto the front side 130 of the lumbar pad between and over each of the vertically-oriented fabric straps 230, 240 from which the frame connectors 220 are formed is a horizontally-oriented reinforcement strap 250. This helps to prevent any inadvertent loosening of the fabric straps and a concomitant expansion of the apertures 225 in the frame connectors 220.

The width of fabric straps 230, 240, and thus the width of frame connectors 220, is slightly narrower than the longest dimension (i.e., the length) of the upper and lower horizontally-oriented portions 105 of the I-shaped slots 75; and the thickness of the fabric straps when doubled (i.e., doubled back on itself, such as in the frame connector bends), is less than the width of the opening of the upper and lower horizontally oriented portions 95, 105 of the I-shaped slots 75. Accordingly, in assembly, the frame connectors (fabric loops or bends) 220, can be pressed flat or approximated and inserted through the horizontally-oriented portions of the I-shaped slots [see FIG. 3B]. When so inserted, each of the frame connectors 220 present an elongate aperture 225 extending at least in part above the exposed (outer) side 74 of the lower lumbar support plate 70 of the SCBA frame, such that an elongate element may be removably inserted into the aperture 225. As will be more fully described below, the elongate elements are structural and operational features of the improved quick release mechanism of the present invention and are sized such that they bear upon the surface 76 of the lumbar support plate [see FIG. 3C].

Accordingly, in an embodiment, slide clips 260 are provided, each including a fork portion with tines or prongs 270 integrally extending from, and joined at their proximal ends by, a base or yoke portion 280, preferably flat or planar on each of its sides, which is bent into a handle or finger hold 290 for gripping by a user when removing the slide clip 260 from the frame connectors 220. Ends 275 of the tines are rounded to prevent them from catching in fabric threads during installation (insertion) into frame connector apertures.

A resilient plate 300 is riveted or otherwise affixed to the outer side 310 of the slide clip finger hold and extends a slight distance beyond the rear side 320 of the base portion; thereafter it is bent back along the rear side of the base portion to form a space 325 to accommodate a portion of the perimeter edge 115 of the lumbar support pad, which will be inserted between the resilient plate and the tine when the slide clip is installed. The bend is made at such an angle $\alpha$ that the leg portion 305 of the resilient plate 300 converges on the place of the space between the tines 270, which defines the slot 330 between the tines 270. Because the plate is resilient, the configuration creates a spring member providing a bias of the leg against the tines. Thus, when installed, the slide clip grips or captures the lumbar support pad and provides increased resistance to removal from the frame connectors over and above the resistance to inadvertent removal from the frame connector apertures due to the friction fit. The resilient plate also includes a raised portion or bend 340 that enables a user during assembly to employ a finger to push the plate downward or rearward away from the tines to facilitate spacing the resilient member and tines to accommodate the perimeter edge 115 of the lumbar support pad 110.

As will be readily appreciated, installation of the quick release system is a simple matter. First, the fabric elements of each of the frame connectors 220 are pressed together to enable them to be inserted through the horizontal portions of the I-shaped slots 75. Next, the slide clips are installed on the lumbar support pad and in the frame connectors by pressing the bend 340 down and away from the tines so as to create a gap. The separation permits the tines 270 to be inserted into the apertures 225 in the frame connectors. The SCBA frame is thereby coupled to the waist belt.

Next, to connect the SCBA frame to a trucker's belt, the belt-capturing member 140 on the rear side 120 of the lumbar support pad 110 is opened and a length of the trucker's belt is placed between the upper and lower folds 150, 160. The upper and lower flaps 170, 180, are folded over, pressed together to approximate the hook and loop fastener surfaces, and the flaps are then snapped shut using snaps 210.

It will be appreciated, however, that the lumbar support pad need not be a distinct and separate structural element of the quick release system. While practical constraints favor such a configuration, the lumbar support pad could, in other embodiments, be incorporated into the waist belt as an inseparable, integral part.

Figure 5A:
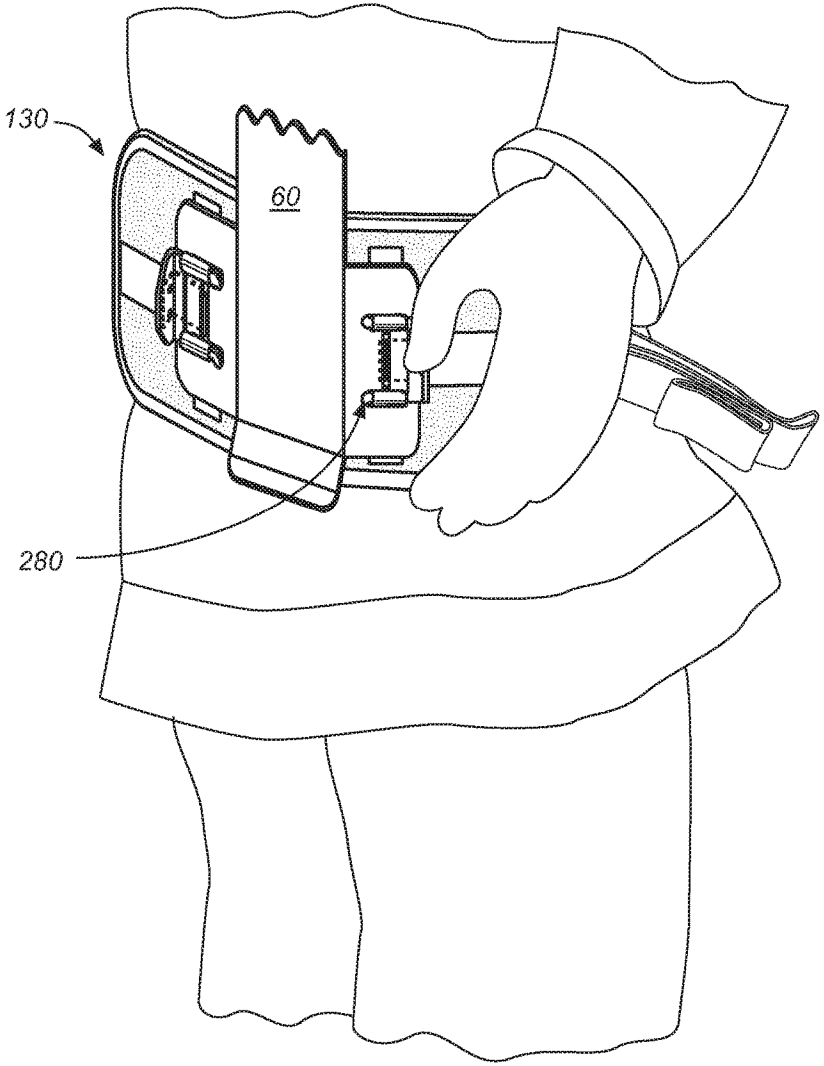
FIG. 5A is a schematic side view in elevation showing a firefighter wearing an SCBA mounted on an SCBA frame coupled to a trucker's belt using an embodiment of the present invention.
Figure 5B:
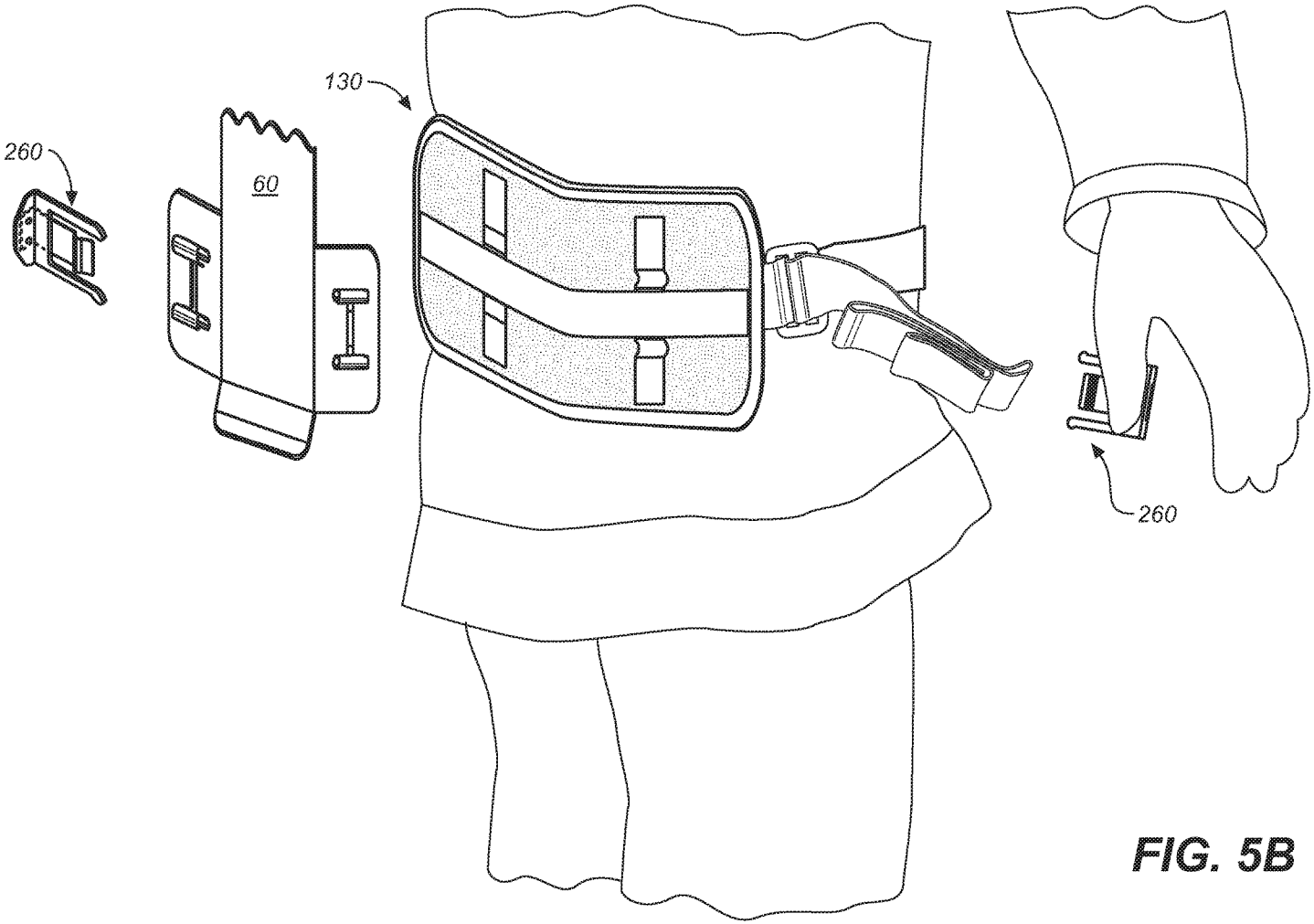
FIG. 5B is an upper rear perspective view showing detail of a firefighter pulling out one quick release slide clip from the lumbar support portion of the quick release apparatus of an embodiment of the present invention while donning an SCBA unit, the other clip shown removed, so as to effect a complete removal of the lumbar support pad from the lumbar support plate of the SCBA frame, thereby freeing the SCBA for removal from the waist belt.

Referring now to FIGS. 5A-5B, if a firefighter encounters a situation in which his safety could depend upon quickly jettisoning the SCBA and its frame while still keeping the trucker's belt and any gear carried on the belt, he need only grasp the slide clips 260 with the fingers of each hand and pull the clips outwardly and away from the waist belt and SCBA frame. Once the slide clips are pulled, the SCBA frame is physically released from the waist belt and the firefighter need only slip off the shoulder straps to free himself from the SCBA unit. The trucker's waist belt remains around his waist and provides easy access to any tools the worker has carried on his person into the perilous circumstances.

The above disclosure enables one of ordinary skill in the art to practice the invention. There is provided herein a full and complete disclosure of preferred embodiments of this invention. However, the disclosure is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

For instance, in an embodiment the frame connector elements may be partial tube members fabricated from relatively rigid materials, such as plastic or metal, sized for insertion through the horizontal slot portions and secured to the lower lumbar support pad with adhesives, welds, or material extensions that enable anchoring a portion of the tube to the support pad. Therefore, the above description and illustrations should not be construed as limiting the scope of the invention, which is defined by the appended claims.

What is claimed as invention is:

1. A quick release apparatus, in combination with a lumbar support plate of an SCBA support frame coupled thereto, for rapidly coupling a self-contained breathing apparatus ("SCBA") support frame to, and decoupling the same from, a rescue worker's waist belt, the SCBA support frame including a lumbar support plate having right and left sides and horizontally disposed slots proximate each of the right and left sides, said quick release apparatus comprising:

a lumbar support pad having a front side and a rear side;

first and second SCBA support frame connectors disposed on said front side and positioned so as to align with and insert through the horizontally disposed slots in the SCBA lower lumbar support plate, said frame connectors including an elongate aperture; and first and second slide clips, each including a base portion, a fork portion having at least one tine integrally extending from and joined at a proximal end to said base portion and sized to insert into one of said elongate apertures of one of said frame connectors, a finger hold integrally attached to or affixed to said base portion, and a resilient plate affixed to either of said base portion or said finger hold and including a leg providing a bias against said at least one tine.

2. The quick release apparatus of claim 1, wherein said resilient plate is affixed to a rear side of said finger hold and extends beyond a rear side of said base and is thereafter bent to extend along the rear side of said fork portion to form a pad capturing space.

3. The quick release apparatus of claim 2, wherein said pad capturing space accommodates a portion of a perimeter edge of said lumbar support pad.

4. The quick release apparatus of claim 1, wherein said fork portion includes two spaced apart tines.

5. The quick release apparatus of claim 1, wherein said resilient plate leg converges from said finger hold toward said at least one tine so as to create a biasing member that clamps onto said lumbar support pad when said at least one tine is inserted in said aperture in one of said frame connectors.

6. The quick release apparatus of claim 5, wherein each of said slide clips includes two tines defining a space therebetween.

7. The quick release apparatus of claim 6, wherein said leg of said resilient plate converges from said finger hold to said space between said tines.

8. The quick release apparatus of claim 1, wherein each of said at least one tine are rounded at a distal end.

9. The quick release apparatus of claim 1, wherein said frame connectors comprise fabric strips affixed to said front side of said lumbar support pad.

10. The quick release apparatus of claim 9, wherein said base portion is planar.

11. The quick release apparatus of claim 10, wherein said base portion and said finger hold are integral.

12. The quick release apparatus of claim 1, wherein said lumbar support pad is integral with the waist belt.

13. The quick release apparatus of claim 1, wherein said lumbar support pad includes a selectively openable belt capturing sleeve disposed on said rear side.

14. The quick release apparatus of claim 13, wherein said belt capturing sleeve is a fabric sleeve including an upper fold, a lower fold, upper and lower flaps, each having hook and loop fastener material which overlap to form an enclosure surrounding the waits belt.

* * * * *